United States Patent [19]

Buzano et al.

[11] Patent Number: 4,628,682

[45] Date of Patent: Dec. 16, 1986

[54] SPUN FIBRE YARN AND METHOD FOR ITS MANUFACTURE

[75] Inventors: Michel Buzano; Michel Randon, both of Lyons, France

[73] Assignee: Rhone-Poulenc Fibres, Lyons, France

[21] Appl. No.: 627,541

[22] Filed: Jul. 3, 1984

[30] Foreign Application Priority Data

Jul. 4, 1983 [FR] France ..... 83 11216

[51] Int. Cl.[4] ..... D02G 3/34

[52] U.S. Cl. ..... 57/206; 57/350; 57/908

[58] Field of Search ..... 57/200, 206, 908, 350, 57/207–209, 289, 328, 254

[56] References Cited

U.S. PATENT DOCUMENTS

| | | | |
|---|---|---|---|
| 3,529,413 | 9/1970 | Marrinan et al. | 57/908 X |
| 3,568,426 | 3/1971 | Whitley | 57/908 X |
| 3,837,155 | 9/1974 | Lloyd et al. | 57/908 X |
| 4,069,565 | 1/1978 | Negishi et al. | 57/350 X |
| 4,384,448 | 5/1983 | Wilkie | 57/350 X |
| 4,489,542 | 12/1984 | Buzano et al. | 57/908 X |

*Primary Examiner*—Donald Watkins
*Attorney, Agent, or Firm*—Sherman & Shalloway

[57] ABSTRACT

A twisted spun fibre yarn with interlaced plies, in which the fibres have a spiral structure having open zones and closed zones, the cohesion factor of the spun fibre yarn being less than 100 and preferably between 20 and 80, the torsion factor of the spun yarn having a value of between 25 and 40% of the torsion factor normally used in the conventional processes for a spun yarn of the same count.

A method and apparatus is also described for its manufacture this involving the use of a pneumatic interlacing means and which may be used either continuously or discontinuously.

9 Claims, 3 Drawing Figures

SPUN FIBRE YARN AND METHOD FOR ITS MANUFACTURE

The present invention relates to a product of the spun fibre yarn type, obtained by the combination of a conventional spinning process with a pneumatic means for interlacing textile fibres, and also to a method and apparatus for its manufacture.

French Pat. App. No. 81/24,469 of 28.12.81, published under No. 2,519,035 and corresponding to U.S. Pat. No. 4,489,542, relates to a product of the spun fibre yarn type with interlaced plies, in which the yarn has a structure of parallel plies without a spiral, possessing open zones, the fibres being interlaced and unbonded in the closed zones and with parallel plies in the open zones also containing free plies, the cohesion factor of the spun fibre yarn being greater than 100 and preferably between 120 and 180.

Despite the high cohesion factor of the spun fibre yarn obtained, it was possible, in certain cases, to observe slippage of the plies during their subsequent conversion, which for certain applications, can cause defects and even breaks, the strength of the spun yarn being reduced as a result of this slippage.

French Pat. App. No. 82/16,347 to 27.09.82, published under No. 2,533,593, and corresponding to copending U.S. patent application Ser. No. 528,559, proposed this kind of product of the spun fibre yarn type, in which the support for interlaced fibres is in a central or core position and free ends of the open zones are wound around it, the length of the free ends being at least equal to the mean circumference of the support, these free ends forming an envelope.

This gave a better compaction, making it possible to avoid interfibre slippage in the non-interlaced open zones; despite the low interlacing factor, faggoting made it possible to produce a yarn of improved strength and lower elongation.

To obtain products of the spun fibre yarn type of higher strength and non-faggoted appearance, a faggoted appearance being undesired in certain applications such as articles with pique piles, it was then possible to reduce the parameters of pressure, compressed air flow rate or yearn pick-up speed, although this was rather incompatible with the economic concepts a spun yarn production.

According to the present invention, we provide a twisted spun fibre yarn with interlaced plies, wherein, in the spun yarn, the fibres have a spiral structure possessing open zones and closed zones, the cohesion factor of the spun yarn being less than 100 and preferably between 20 and 80, the torsion factor of the spun yarn having a value of between 25 and 40% of the torsion factor normally found in the conventional spun yarn having the same count.

The invention also provides a method for the manufacture of a spun yarn, said method comprising the steps of feeding a slubbing or sliver to a drawing frame and drawing it, subjecting the drawn product on leaving the drawing frame to at least one operation for interlacing the plies by a pneumatic means, the angle formed between the yarn as it is fed to the pneumatic means and the axis of the channel in which the yarn passes through the pneumatic means between 0° and 80°, the distance between the pneumatic means and the outlet of the drawing frame being at most equal to the mean length of the fibres treated, and then subjecting the yarn leaving said pneumatic means to a twisting operation involving winding of the spun yarn on to a tube fitted to a rotating vertical spindle, via a conventional ring/cursor means, the torsion factor of the resulting yarn between 25 and 40% of the torsion factor normally used in the conventional method of a spun yarn of the same count.

The fluid pressure used in the interlacing means is preferably between 1.5 and $4.10^5$ Pa, the angle formed between the yarn and the axis of the channel in which the yarn passes through the pneumatic means is preferably between 20° and 60°.

The present invention also provides apparatus for the manufacture of a spun fibre yarn, said apparatus comprising means for forming a slubbing or silver, a drawing frame, a pneumatic interlacing means, a relaxation zone and a spindle ring/cursor assembly for winding the resulting spun yarn.

A spinning process is limited on account of the restricted speed of the vertical spindles, the light weight of the take-up tubes and the strength of the equipment. It can thus be advantageous, in the manufacture of the spun yarn to separate the pneumatic interlacing step from the actual twisting step, in which latter case, the method for the manufacture of the spun fibre yarn is discontinuous.

Thus the present invention also provides a method for the discontinuous manufacture of a spun yarn, said method comprising the steps of feeding a slubbing or silver of fibres to a drawing frame, subjecting the drawn product leaving the drawing frame to a pneumatic interlacing means at a speed up to 300m/min, so that the resulting product has a cohesion factor of less than 100, picking up the product leaving the pneumatic means on a pick-up tube in the form of bobbin, and subsequently picking-up and twisting the yarn would on to the bobbin either with itself or with other similarly formed yarns.

It has been noted, in fact, that the pseudo-knots imparted by the interlacing of crimped fibres have a low resistance to longitudinal slippage when the fibres are placed under tension, the turns of twist given by compacting the fibres in a spiral movement tending to close the whole of the spun fibre yarn and to prevent interfibre slippage, increasing the adhesion factor between fibres and thus locking the pseudo-knots.

It has also been noted that the interfibre cohesion factor can advantageously replace 60% of the usual torsion value and, on certain fibres with a low coefficient of friction between fibres, can lead to strength values approximately equal to those obtained in the conventional spinning process.

It has thus been possible to observe that the resulting product of the spun fibre yarn type has a sufficient strength for all textile applications, in particular for furniture applications such as articles with piqué piles. The spun yarn can be used by itself, either twisted or multiple-would, or in combination with other forms such as continuous yarn or other spun fibre yarns. The spun yarn has a good uniformity due to the fact that the open and closed zones are less pronounced, this reduction in the prominence of the zones being advantageous in woven fabrics with piqué piles for use as floor covering, where this permits a good spreading of the tufts and a good covering capacity.

This process has the advantage of permitting the use of the conventional spinning equipment without substantial conversion in order to obtain a higher production speed, thus increasing the productivity of the equipment in a ratio which can range from 1 to 3.

As regards the discontinuous process, the speed of passage of the yarn through the pneumatic means is high and can range up to speeds of the order of 300 m/minute, the cohesion factor being less than 100. The yarn is picked up on a take-up tube in the form of a bobbin, which can be very heavy. It is then taken up and twisted, by itself or to several ends, on any known means such as a stranding machine, a double-twist spindle, a twisting frame or the like. The advantage offered by this process is that it uses conventional equipment and, in certain cases, reduces the number of product conversion steps.

The fluidic means used is generally a single-jet nozzle of the open type, namely of the type having a slit allowing a yarn, sliver or slubbing to be introduced more easily during manufacture. This nozzle is fed with fluid, which is generally air, at a pressure preferably of between 1.5 and $4.10^5$ Pa. The temperature of the fluid is generally ambient temperature and can be higher if it is desired to obtain special effects when using fibres having particular characteristics (shrinkage, latent crimp and the like). The distance between the pneumatic means and the outlet of the drawing frame is at most equal to the mean length of the fibres treated.

The interlacing means is generally located between the outlet of the drawing frame and a pair of intermediate rolls enabling the tension in the nozzle to be controlled, it being possible for the distance between the drawing frame and the relaxation rolls to vary from 40 to 200 mm. The angle formed between the yarn leaving the drawing frame and the axis of the channel in which the yarn passes through the nozzle is between zero and 80° and preferably between 20° and 60°, so that the air jet induced on escape does not interfere with the arrangement of the fibre leaving the stretching gear.

The following description which is given merely by way of example, will provide a clearer understanding of how the invention is carried out.

BRIEF DESCRIPTION OF THE DRAWINGS

FIG. 1 shows the textile 1 to be spun, delivery rolls 2 at the outlet of the conventional drawing frame (not shown), an interlacing nozzle 3, feed rolls 4, a pig-tail guide 5, a ring/cursor rasing and lowering system 6, and a tube 7 on which the spun fibre yarn 8 is wound.

Figure 1:
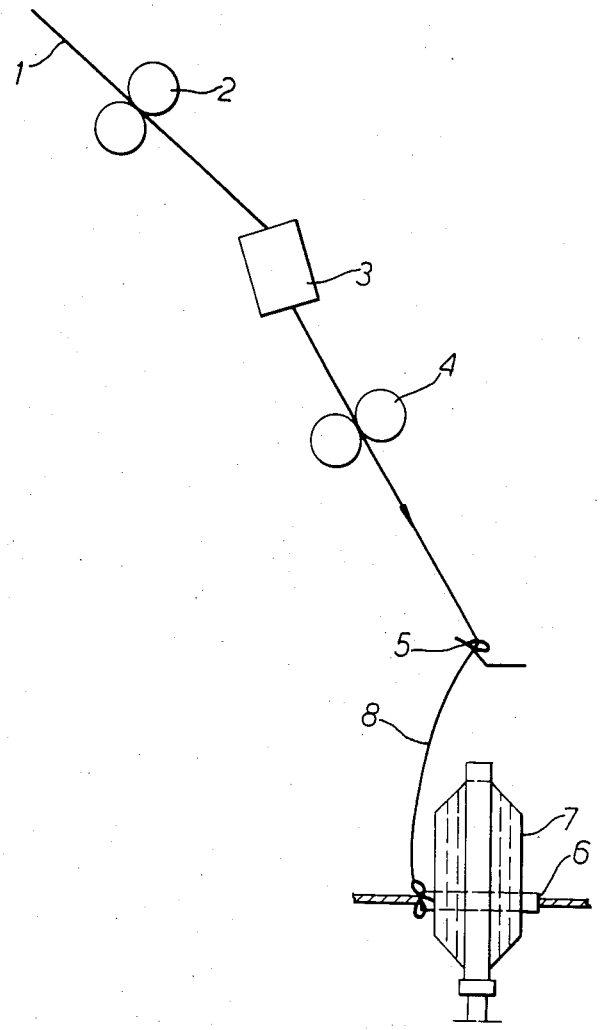
FIG. 1 is a schemetic representation of the method and apparatus for the manufacture of the spun fiber yarn.

In operation, the textile to be spun, 1, in the form of a slubbing or sliver, is fed to drawing frame (not shown) and leaves the latter through the delivery rolls 2. The drawn textile product then passes through the nozzle 3 fed with fluid, which interlaces the fibres; the interlaced product then passes between the feed rolls 4 generally rotating at a lower speed than the delivery rolls, and passes through the pig-tail guide 5, and it receives a twist and is wound, in the form of spun yarn 8, on to the tube 7 fitted to a rotating spindle, having passes beforehand through the ring-cursor means 6 which is given the conventional raising and lowering movement.

Figure 2:
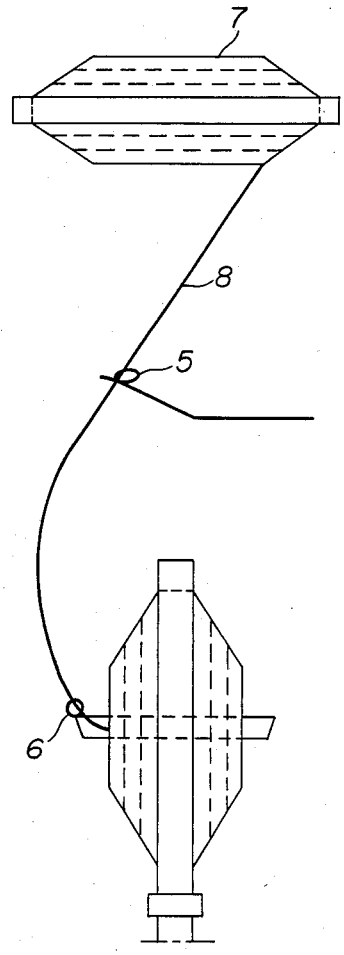
FIG. 2 is a schematic representation of the method and apparatus for twisting the spun fibre yarn with itself in a discontinuous process.
Figure 3:
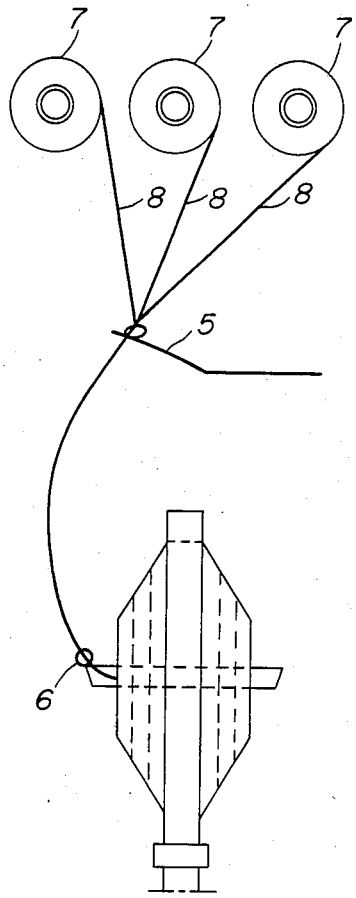
FIG. 3 is a schematic representation of the method and apparatus for twisting the spun yarn with other spun yarns in a discontinuous process.

FIGS. 2 and 3 illustrate the twisting of the spun fibre yarn with itself and with other spun fibre yarns on conventional apparatus as part of the discontinuous process previously discussed.

The resulting product of the spun fibre yarn type can be used for any textile application, preferably for articles with pique piles, furniture, haberdashery, interior covering for coachwork, and the like.

The pneumatic means can easily be fitted to any traditional spinning system for short or long fibres, in a system for cotton, worsted yarn, half-worsted yarn or wool.

The examples which follow illustrate the present Application without limiting it.

EXAMPLE 1

A spun fibre yarn product of metric count 3.8 is produced from a silver of 8.5 g/meter, obtained after carding a 70/30% blend of polyhexamethyleneadipamide fibres with respective counts of 19 and 11 dtex and respective lengths of 170 and 150 mm, followed by 3 intersecting passes. The slubbing of 8.5 g/m is fed to a frame for half-worsten yarn, of SCHLUMBERGER make, equipped with SKF-PF-704 drawing frame, and the indicated draw ration is 35.6 for 1 meter. On leaving the drawing gear, the refined slubbing is converted to spun fibre yarn by the conventional process and by the process of the present invention under the following conditions:

(A),—Conventional process
torsion factor: 80
spindle speed: 6,500 rpm
twist: 156 turns/meter
output speed of the drawing frame: 38.5 m/minute
cursor no. 630 (BRAEKERT): diameter of the ring: 93 mm The spun yarn obtained has the following characteristics:

Metric count: 3.8
Uniformity, U%: 13, breaking load 4,290 grammes, 4 weak points, 4 strong points.

(B),—Process according to the invention
torsion factor: 31
spindle speed: 6,500 rpm
twist: 61 t/meter
output speed of the drawing frame: 106 m/minute
cursor number: 1,250

The interlacing nozzle is fed with air at ambient temperature at a pressure of $3.10^5$ Pa and is located 100 mm from the delivery rolls, the slubbing entering along the axis of the nozzle to form an angle of 45° with the vertical plane passing through the axis of the delivery rolls; separation between nozzle and relaxation rolls: 100 mm; relaxation between nozzle outlet and intermediate rolls: 2%.

The yarn obtained has the following characteristics:

Metric count: 3.8
U% = 14.5
Cohesion factor: 55
Breaking load: 3,520 grams 120 weak points, 20 strong points, 15 imperfections.

The yarn obtained has good characteristics compared with those of the spun yarn of the same metric count obtained by the conventional process; furthermore, it is produced at a speed of nearly 3 times that of the conventional process, which is advantageous from the point of view of the economics of running the process.

EXAMPLE 2

A sliver of 8.5 g/meter, prepared in the traditional manner, by carding and 3 intersecting passes, from polyhexamethyleneadipamide fibres with counts of 19 dtex and 11 dtex, blended in a proportion of 70% of 19 dtex fibres cut to 170 mm and 30% of 11 dtex spun yarn cut to 150 mm, is fed to an NSC CP 33 frame for half-worsted yarn, of SCHLUMBERGER make. The spindle speed of the frame is set at 6,500 rpm and the torsion factor applied is 31, which, for the desired metric count of 3.8, represents a twist of 61 t/meter.

In a first experiment, the nozzle of the single-jet type is arranged as in Example 1, but is not fed with compressed air.

The spun yarn obtained on winding with 61 t/meter of twist is extremely pilose and has a breaking strength of less than 100 g; furthermore, it would be impossible to operate the frame under these conditions, due to the breaks at the cursor.

In a second experiment, the single-jet nozzle is fed under a pressure of $3.10^5$ Pa; the relaxation between the lamination stage and the intermediate roll is adjusted to 2% relative to the feed stage, in order to allow the fibres to arrange themselves correctly in the interlacing nozzle.

The twist is kept at the same value. The spun yarn obtained has a strength of 2,989 g.

EXAMPLE 3

Under the conditions given in Example 1, a spun fibre yarn is produced by the conventional process (Experiment D) and spun fibre yarns are produced by the process of the present invention, the pressure fed to the pneumatic means being varied (experiments A, B and C).

The conditions and results are as follows:

| Experiment | A | B | C | D |
|---|---|---|---|---|
| Pressure $.10^5$ Pa | 3.5 | 3 | 2.5 | 0 |
| Metric count | 3.8 | 3.8 | 3.8 | 3.8 |
| Torsion factor | 31 | 31 | 31 | 31 |
| Turns/m | 61 | 61 | 61 | 61 |
| Spindle speed, rpm | 6,500 | 6,500 | 6,500 | 6,500 |
| Speed of spun yarn m/min | 106 | 106 | 106 | 38.5 |
| U % Uster | 14.5 | 14.9 | 15.1 | 15.9 |
| Strength, g | 3,580 | 2,989 | 2,181 | 4,280 |
| Coefficient of variation of strength | 13 | 17.8 | 44.9 | 11 |
| Weak points | 150 | 425 | 532 | 12 |
| Strong points | 20 | 50 | 44 | 4 |
| Imperfections | 15 | 30 | 144 | 4 |
| Cohesion factor | 55 | 42 | 20 | 0 |

These results show that the yarns obtained by the process of the invention have similar properties to the yarn obtained by the conventional process as in Experiment A or adequate properties for certain uses as in Experiments B and C, but always with a production speed nearly 3 times higher.

EXAMPLE 4

An acrylic fibre sliver, made up of a blend of 50% of set fibres and 50% of shrinkable fibres with a count of 5 dtex per ply, is prepared from a dyed tow. The weight of the sliver prepared in the traditional manner is 7 g/m.

On a frame for half-worsted yarn, fo the CF 33 NSC type, a spun fibre yarn with a metric count of 5 is produced under the conditions defined in Example 3. The indicated stretching ration of 35.6; the relaxation between the outlet of the drawing frame and the intermediate roll is 1.5%; the nozzle is located at the same distance from the two rolls, that is to say 100 mm from each one; the single-jet nozzle, of injection diameter 2 mm and yarn passage diameter 3 mm, is fed with air at a pressure of $1.10_5$ Pa to $3.10^5$ Pa. The speed of the spindle is adjusted to 6,500 rpm. The comparative results are as follows:

| Experiment | E | F | G | H conventional |
|---|---|---|---|---|
| Pressure $.10^5$ Pa | 1 | 2 | 3 | 0 |
| Metric count | 5 | 5 | 5 | 5 |
| Torsion factor | 29 | 29 | 29 | 60 |
| Twist/meter | 65 | 65 | 65 | 134 |
| Winding speed, m/min | 100 | 100 | 100 | 48.5 |
| U % | 9 | 8.3 | 8.8 | 7.4 |
| Cohesion factor | 36 | 64 | 86 | 0 |
| Strength, g | 1,738 | 2,074 | 2,157 | 2,387 |
| Weak points | 0 | 0 | 0 | 0 |
| Strong points | 0 | 0 | 16 | 0 |
| Imperfections | 0 | 8 | 56 | 0 |

The yarn obtained clearly has similar characteristics to the traditional spun yarn and is produced at twice the speed.

EXAMPLE 5

A spun fibre yarn with a metric count of 20/1 is produced continuously according to the invention in the following manner.

A slubbing with a metric count of 1.2 is treated, which is composed of a fibre blend of 60% of semi-matt polyester fibres with a count of 3.3 dtex, obtained by conversion of a tow of length three and a half inches, and 40% of semi-matt 2- component polyester fibres with a count of 3.3 dtex, obtained by conversion of a tow of length three and a half inches.

The production conditions and results obtained are collated below:

| | Experiment I according to the Invention | Experiment J conventional |
|---|---|---|
| type of stretching | PK 628 | idem |
| stretching ratio | 16.6 | idem |
| length of the stretching zone mm | 220 | idem |
| spindle speed, rpm | 8,600 | 8,600 |
| torsion factor | 36 | 85 |
| turns per meter | 161 | 380 |
| diameter of the rings, mm | 55 | 55 |
| cursor no. | 19 | 19 |
| relaxation, % | 3 | — |
| yarn production speed, m/min | 53 | 22.6 |
| pressure in the nozzle $.10^5$ Pa | 1 | — |
| metric count | 19.9/1 | 20.5/1 |
| elongation, % | 23.2 | 27.6 |
| strength, g | 750 | 1,004 |
| breaking length | 14.9 | 20.18 |
| coefficient of variation | 14 | 9.96 |
| U % | 13 | 11.2 |
| weak points | 64 | 36 |
| strong points | 28 | 12 |
| imperfections | 48 | 20 |

The spun yarn obtained by the continuous process of the present invention has similar characteristics to the spun yarn obtained by the conventional process without a pneumatic means, and is produced at twice the speed.

What is claimed is:

1. A spun-like interlaced twisted fiber yarn with interlaced plies, wherein in the spun yarn, the fibers have a spiral structure possessing open zones and closed zones, the cohesion factor of the spun yarn being less than 100, the torsion factor of the spun yarn having a value of between 25 and 40% of the torsion factor normally found in the conventional spun yarn having the same count.

2. A spun-like interlaced twisted fiber yarn as in claim 1, wherein the interfiber cohesion factor is between 20 and 80 and replaces up to 60% of the torsion factor normally found in conventional spun yarn.

3. A method for the manufacture of a spun yarn, said method comprising the steps of feeding a slubbing or sliver to a drawing frame and drawing it, subjecting the drawn product on leaving the drawing frame to at least one operation for interlacing the plies by a pneumatic means, the angle formed between the yarn as it is fed to the pneumatic means and the axis of the channel in which the yarn passes through the pneumatic means being between 0° and 80°, the distance between the pneumatic means and the outlet of the drawing frame being at most equal to the mean length of the fibres treated, and then subjecting the yarn leaving said pneumatic means to a twisting operation involving winding of the spun yarn on to a tube fitted to a rotating vertical spindle, via a conventional ring/cursor means, the torsion factor of the resulting yarn being between 25 and 40% of the torsion factor normally used in the conventional method for a spun yarn of the same count.

4. A method according to claim 3, wherein the pressure of the pneumatic means is between 1.5 and $4.10^5$ Pa.

5. A method according to claim 3, wherein said angle between the yarn as it is fed to the pneumatic means and the channel in which the yarn passes through the pneumatic means is between 20° and 60°.

6. A method according to claim 3, wherein the spun yarn is subjected, as it is being formed, to a relaxation step.

7. A method for the discontinuous manufacture of a spun yarn, said method comprising the steps of feeding a slubbing or sliver of fibers to a drawing frame, subjecting the drawn product leaving the drawing frame to a pneumatic interlacing means at a speed up to 300 m/min, so that the resulting product has a cohesion factor of less than 100, picking up the product leaving the pneumatic means on a pick-up tube in the form of a bobbin, and subsequently picking up said product from said bobbin and twisting it with itself to form the final spun yarn.

8. A method for the discontinuous manufacture of a spun yarn, said method comprising the steps of feeding a slubbing or sliver of fibers to a drawing frame, subjecting the drawn product leaving the drawing frame to a pneumatic interlacing means at a speed up to 300 m/min., so that the resulting product has a cohesion factor of less than 100, picking up the product leaving the pneumatic means on a pick up tube in the form of a bobbin, and subsequently picking up said product from said bobbin and twisting it with other continuous or spun fiber yarns.

9. A method for the manufacture of a spun yarn as in claim 3, wherein said pneumatic means are applied to the spinning of short or long fibers in a system for cotton, worsted yarn, half-worsted yarn or wool.

* * * * *